United States Patent [19]

Mendelsohn et al.

[11] 4,091,311

[45] May 23, 1978

[54] MODULATABLE, HOLLOW BEAM ELECTRON GUN

[75] Inventors: Charles Mendelsohn, Monsey, N.Y.; Holger Martin Luther, Westport, Conn.

[73] Assignee: United Technologies Corporation, Hartford, Conn.

[21] Appl. No.: 751,561

[22] Filed: Dec. 17, 1976

[51] Int. Cl.[2] ..... H01J 29/58

[52] U.S. Cl. ..... 315/382; 315/5.31; 313/455

[58] Field of Search ..... 315/14, 372, 374, 375, 315/382, 31 R, 31 TV, 5.31, 5.34; 358/66, 71, 218; 313/455, 361, 370, 372

[56] References Cited

U.S. PATENT DOCUMENTS

| | | | |
|---|---|---|---|
| 2,936,396 | 5/1960 | Currie | 313/455 X |
| 2,997,615 | 8/1961 | Adler | 313/455 X |
| 3,013,179 | 12/1961 | Harris | 313/455 X |

*Primary Examiner*—Maynard R. Wilbur
*Assistant Examiner*—T. M. Blum
*Attorney, Agent, or Firm*—Dominic J. Chiantera

[57] ABSTRACT

A modulatable, hollow beam electron gun assembly includes an electron-optical (E-O) column having a fixed diameter ring, dispenser type cathode assembly for providing a hollow electron beam through thermionic emission from a hollow cylindrical cathode element, first and second control grid assemblies, a first anode assembly and a second anode assembly, which in combination with a beam modulator assembly comprises an electrostatic coaxial lens assembly. The grid and anode assemblies provide control of the emitted beam current density. The beam modulator assembly includes an axial electrode positioned along the longitudinal axis of the second anode assembly and first and second hollow, anode modulator rings disposed within the second anode and circumscribing a different portion of the axial electrode, each modulator ring responsive to modulation signals presented to each at a substantially complementary magnitude and polarity to provide a hollow electron beam having an average diameter provided by an instantaneous outer diameter and inner diameter value, the ratio of which defines an aspect ratio of the beam.

7 Claims, 4 Drawing Figures

MODULATABLE, HOLLOW BEAM ELECTRON GUN

CROSS REFERENCE TO RELATED APPLICATION

The subject matter hereof is also disclosed, and some of it is claimed, in a commonly owned copending application entitled A MASK-LESS SINGLE ELECTRON GUN, COLOR CRT, Serial No. 751,560, filed on even date herewith by Charles Mendelsohn.

BACKGROUND OF THE INVENTION

1. Field of Invention

This invention relates to electron gun apparatus for providing an electron beam for use in a visual display cathode ray tube, and more particularly to a modulated electron gun apparatus for providing a hollow electron beam whose average beam diameter may be modulated over a determined range to provide a plurality of different discrete average diameter values within the range.

2. Description of the Prior Art

In certain video display systems having a cathode ray tube (CRT), it is desirable to provide excitation of each of a plurality of different phosphor groupings disposed on a faceplate of the CRT in a concentric, determined geometric pattern, such as that shown and described in the hereinbefore referenced, copending application. This phosphor grouping precludes the use of a conventional solid electron beam, but requires a hollow electron beam capable of providing a plurality of suitable average diameters to excite the selected one of the concentric phosphors without impinging on adjacent phosphors. Similarly, the electron beam must be capable of providing different discrete diameter values in dependence on the diameters of the various concentric phosphor groupings.

In general, electron gun assemblies capable of providing hollow electron beams are known in the prior art, and have been used for a number of years in traveling wave tubes, where a hollow electron beam is propagated through a helix which provides an RF modulating signal to the beam to modulate the electron flow and provide a determined signal gain. In these applications, however, the use of the hollow electron beam is generally required only to limit the power dissipation within the traveling wave tube, since the applied RF signal influences the displacement of only the electrons on the outer surface of the beam and not those on the central portion, the internal electrons represent wasted power. Therefore, in a high power traveling wave tube it is preferred to use the hollow beam to limit the power dissipation and prevent burn out of the anode element. Similarly electron gun structures for providing modulated, hollow electron beams have been used in high power x-ray tubes to limit the tube power dissipation, such as that described in U.S. Pat. No. 3,892,989 to N. M. Gralenski, and entitled "Convergent Flow Hollow Beam X-Ray Gun Construction", where a hollow beam is generated and then modulated continuously by an applied AC signal to limit the high power concentration which would be provided by a solid electron beam, while still maintaining the required high x-ray emission.

At the present time, there is no known electron gun apparatus in the art for providing a hollow electron beam with a plurality of discrete diameter values provided by beam modulation over a determined modulation range and which are suitable for use in a cathode ray tube structure of the type described in the hereinbefore referenced, copending application.

SUMMARY OF THE INVENTION

An object of the present invention is to provide an electron gun assembly capable of producing a hollow electron beam having an average diameter value in dependence on a determined outside diameter and inside diameter value, which may be modulated to provide a plurality of different, discrete average diameter beams within a determined range of diameter values and for determined time intervals, wherein the aspect ratio of the outside diameter to the inside diameter is substantially constant over the modulation range.

According to the present invention, a modulatable, hollow beam electron gun assembly includes an electron-optical (E-O) column having a longitudinal axis, and including a cathode assembly, first and second control grid assemblies, first anode assembly, and an electrostatic coaxial lens assembly including a second anode assembly and an axially symmetrical electrostatic beam modulator assembly disposed within the second anode assembly, each of the elements being successively disposed in a coaxial manner along the longitudinal axis of the E-O column. The cathode assembly is a fixed diameter ring, dispenser type cathode having a cathode casing, and provides a hollow electron beam through thermionic emission from a hollow, cylindrical cathode element. The cathode assembly is enclosed within the first control grid assembly which itself is a concentric, hollow cylindrical structure having an output coaxial aperture of determined diameter value greater than the diameter of the cylindrical cathode emitting element. The second control grid is a similar hollow, cylindrical structure as that of the first control grid, and includes input and output coaxial apertures with the output coaxial aperture having a determined diameter value to provide a restriction on the maximum divergence of the emitted electron beam from the longitudinal axis, the cathode, and first and second control grid assemblies having voltage signals applied thereto for providing, in cooperative relationship, modulation of the electron beam current density in dependence on the magnitude of a video signal applied to a selected one of the elements. The first anode assembly and the electrostatic coaxial lens assembly are coaxially disposed along successive portions of the longitudinal axis of the column, the first anode being separated by a free drift area distance from the output aperture of the second control grid, the first anode assembly and the second anode assembly portion of the electrostatic lens assembly having a different, determined longitudinal length and each connected to a high voltage anode power supply for creating, in combination, a positive electrostatic field for ensuring a low divergence angle for the emitted electron beam at the cathode surface, the first anode assembly also having a coaxial input aperture of a determined diameter smaller than that of the output aperture of the second control grid to provide a further restriction on the divergence of the electron beam. The beam modulator assembly portion of the electrostatic lens assembly is axially symmetrical and centrally disposed within the second anode structure in a coaxial relationship, and includes an axial electrode suspended along the central longitudinal axis of the second anode through structure members connected to the second anode structure which provide electrical interconnection between the second anode structure and the axial electrode, such that each are at the same voltage potential. The beam modulator assembly further includes first and second anode modulator rings, each comprising a generally hollow, cylindrical structure, the combined longitudinal length of each being smaller than that of the second anode assembly such that each are separated by a determined drift space length and enclose a different determined portion of the axial electrode within the second anode structure, each modulator ring is electrically isolated from the second anode assembly and each is connected to the anode voltage supply through a corresponding one of a pair of isolation resistance devices. Each modulator ring is also connected through a corresponding electrical conductor, suitably disposed through the wall structure of the second anode, to a modulation signal source which simultaneously provides individual modulation signals, having a substantially complementary magnitude and polarity, to the first and second modulator rings. Each modulator ring assembly provides within its spatial region a positive electrostatic field at a field intensity in dependence on the magnitude of the anode voltage signal presented to each through the isolation resistance devices, and each provides a complementary change in the intensity of the respective electrostatic fields in response to the absolute magnitude of each of the complementary modulation signals presented thereto, the change in intensity being opposite within the spatial region enclosed by each of the modulator rings and dependent on the magnitude of the respective modulation signal. The modulator rings provide in combination, a sequential diverging and recollimating influence to the electron beam propagating along the longitudinal axis of the E-O column to provide the discrete beam diameter values.

These and other objects, features and advantages of the present invention will become more apparent in the light of the following detailed description of the preferred embodiment thereof, as illustrated in the accompanying drawing.

DESCRIPTION OF THE PREFERRED EMBODIMENT

Figure 1:
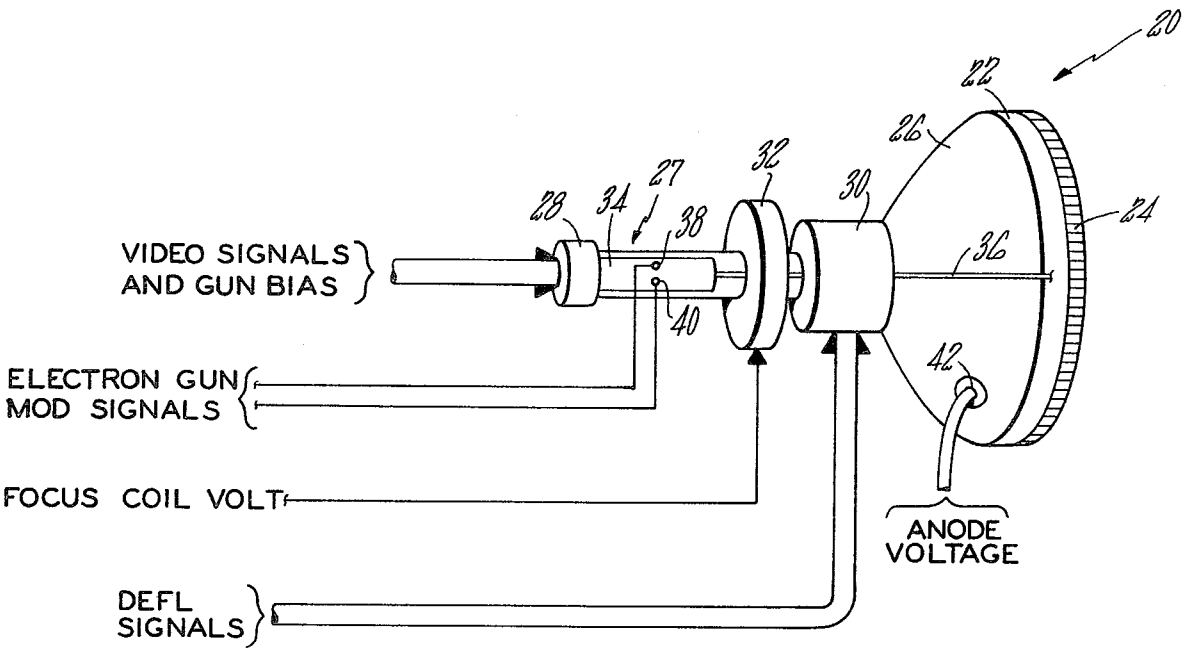
FIG. 1 is an illustration of a cathode ray tube as may be used with the modulatable, hollow beam electron gun of the present invention.

Referring now to FIG. 1, in an illustrative embodiment of the modulatable, hollow beam electron gun of the present invention, a cathode ray tube (CRT) 20 includes a faceplate portion 22 having a video screen formation 24, a funnel portion 26 having a large diameter flared end in register with the faceplate 22 and a small diameter tapered end connected with a cylindrical neck portion 27 extending from the tapered portion of the funnel assembly and an electrical connector 28, all of which are joined in a vacuum seal relationship. An electron beam deflection assembly 30 is disposed on the outside surface of the neck portion at the junction of the neck and funnel portions, and a focusing assembly 32 is disposed on the outside of the neck portion immediately adjacent to the deflection assembly. In a preferred embodiment both the deflection assembly and the focusing assembly are of the electromagnetic type, however, each may be electrostatic assemblies. The modulated, hollow beam electron gun assembly 34 is disposed inside the neck portion 27 between the connector 28 and the focusing assembly 32. As described in detail hereinafter, the electron gun 34 provides a hollow electron beam 36, the current density of which is dependent on the magnitude of video signals and bias voltage signals presented through the connector 28 to the cathode and control grid assemblies thereof, and the average diameter of which is provided in dependence on modulation signals presented through terminals 38, 40 to an electrostatic beam modulator assembly included therein.

The CRT 20 also includes an anode voltage connector 42 disposed through the wall of the funnel portion 26, the connector being in electrical contact with a conductive coating, such as aquadag, disposed on the inside wall of the funnel and neck portions 26, 27, in a similar manner to a prior art CRT. With the exception of the modulatable, hollow beam electron gun assembly 34, the CRT 20 incorporates substantially the same mechanical structure found in a prior art CRT. Similarly, although not shown, the CRT 20 may further include a Mu metal shield around the funnel and neck portions to limit EMI emissions from the tube which may cause interference for the adjacent electrical equipment and to minimize the effects of external electrostatic or electromagnetic fields on the beam itself. Further details of the CRT 20 including the video screen formation 24 are shown and described in the hereinbefore referenced copending application.

Figure 2:
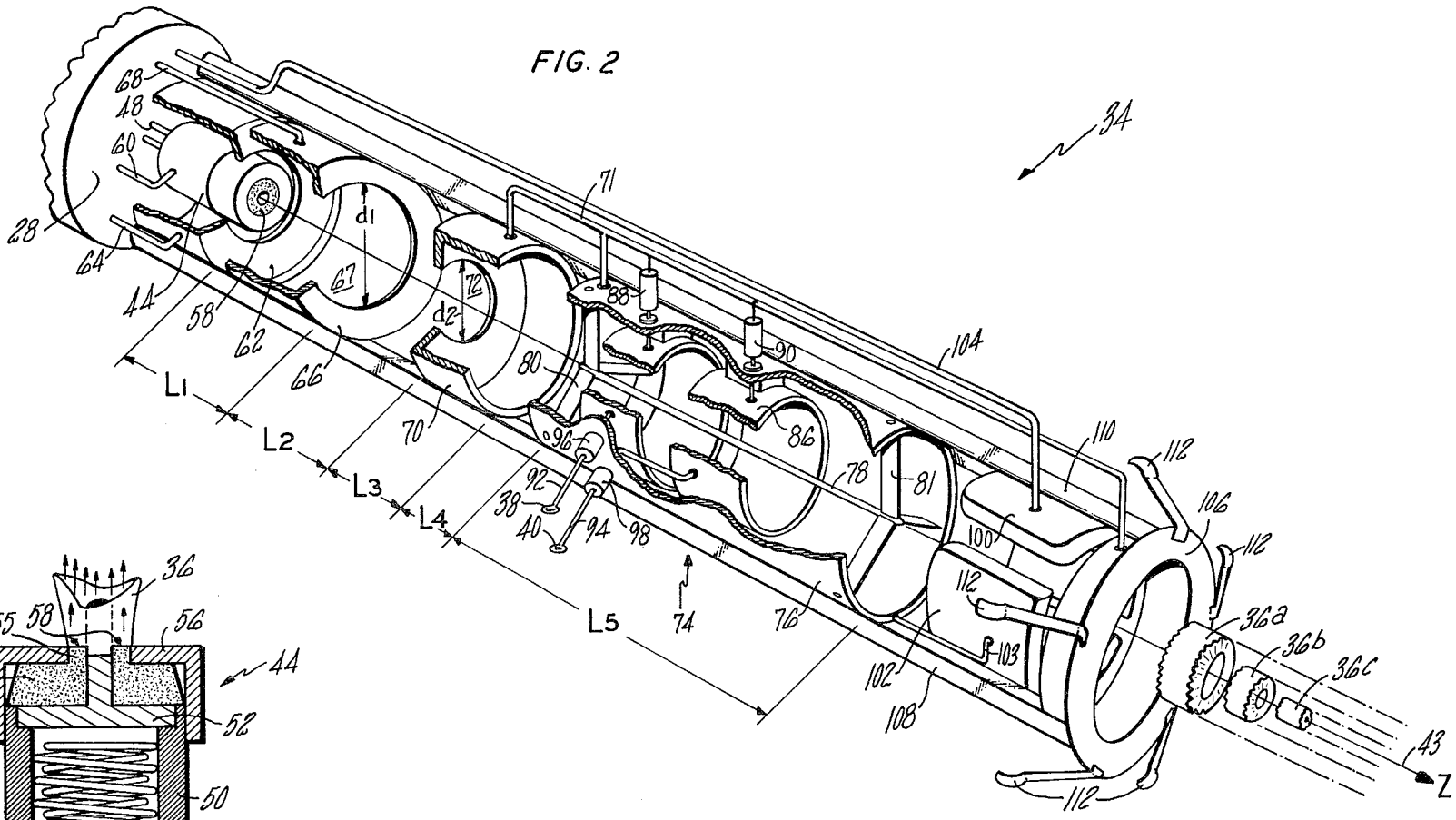
FIG. 2 is a cutaway, perspective illustration of the modulatable, hollow beam electron gun of the present invention, as may be used in the embodiment of FIG. 1.
Figure 3:
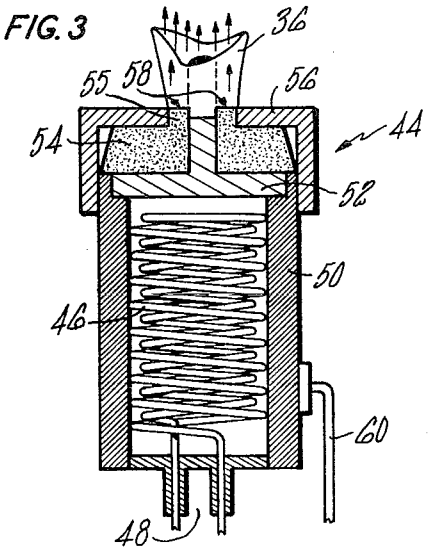
FIG. 3 is a sectional view of one element of the electron gun assembly of FIG. 2.

Referring now to FIG. 2, in a perspective cutaway view of the modulatable, hollow beam electron gun assembly 34, the gun assembly provides an electron-optical (E-O) column centered along a longitudinal Z axis 43. The first element in the column is a fixed diameter ring, dispenser type cathode assembly 44 which provides a hollow electron beam through thermionic emission from a hollow, cylindrical cathode element, as shown in a detailed cutaway view in FIG. 3. Referring to FIG. 3, the cathode assembly 44 includes a heater element 46, of a type known in the art, which may comprise a tungsten filament with two percent rhenium composition to provide long life, and which is catapheritic coated to prevent thermal erosion of the filament and to electrically insulate the filament from the cathode body. The filament voltage is provided through the connector 28 and lines 48 through the lower portion of a molybdenum (Mo) casing 50 which encloses the filament. The other end of casing 50 is capped with an Mo plug 52, press fitted within a recessed portion of the casing, and which has a small diameter, centrally protruding post. The post extends through a central aperture in an impregnated cathode element 54, comprised of a barium strontium oxide composition which has a hollow cylindrical neck portion 55 having an inside diameter equal to the OD of the post. The cathode assembly is covered by an Mo cap assembly 56 having a central aperture with a diameter equal to the OD of the cathode neck portion 55. The exposed hollow cylindrical surface 58 of the neck portion 55 is the electron emitting surface which provides the hollow electron beam 36. The general construction of the dispenser cathode assembly 44, including the filament, case structure, and hollow, cylindrical electron emitting surface, is similar to dispenser type cathode assemblies known in the art. The casing 50 of the cathode assembly 44 is electrically connected through a conductor 60 to the connector 28, to permit an outside voltage signal potential to be applied to the surface of the casing 50, the magnitude of which is dependent on the received video signals and electrical potential applied to control grid assemblies included in the E-O column, as described hereinafter.

Referring again to FIG. 2, the cathode assembly 44 is encased in a first control grid 62 which is a concentric, hollow cylindrical structure, coaxially disposed with the cathode assembly and connected through a conductor 64 to the connector 28, to provide for application of bias voltage signals to the surface of the control grid structure. A second hollow, cylindrical control grid 66 is disposed in coaxial relationship with the control grid 62 and cathode 44 along a successive portion of the Z axis adjacent to the grid 62. The second control grid 66 is similarly connected through a conductor 68 to the connector 28, to permit a bias voltage potential to be applied to the surface area of the control grid. The control grid 66 has a determined length $L_2$ and has coaxial input and output apertures. The input aperture, the one closest to the cathode assembly 44, has a diameter substantially equal to the diameter of the control grid 62 cylindrical body, and the output aperture 67 has a diameter $D_1$ which is smaller than that of the input aperture to provide a restriction on the maximum divergence of the electrons in the beam at that axial position. The spatial volume within the second control grid 66 provides an area in which the electron acceleration is controlled by the relative electric field potential between the cathode, control grids, and high voltage anodes of the CRT. Typical dimensions of the second control grid 66 include a grid length $L_1$ of approximately one centimeter, and an exit aperture diameter $D_1$ on the order of one and one-half centimeters. The magnitude of the voltage potential applied to the second control grid 66 may be of the same, or different magnitude, as that applied to the grid 62, however, it is always negative with respect to the potential applied to the cathode assembly 44. As known generally, the relative negative magnitude between the control grids and cathode assembly control the current density of the electron beam, and the relative magnitude may be changed by changing the voltage magnitude applied to either the cathode, or the control grids.

A first anode assembly 70 is next disposed in coaxial relationship with the cathode and control grid assemblies along the Z axis at a distance $L_2$ from the second control grid 66. The distance $L_2$ provides a free drift area for the beam electrons and is on the order of one centimeter. The anode 70 is similarly a hollow, cylindrical structure having input and output coaxial apertures, and the anode cylinder wall is connected to the high voltage anode supply ($V_A$) of the CRT 20 through a conductor 71 in electrical contact with the aquadag coating along the inside surface of the funnel 26 and neck portion 27 of the CRT. The length $L_3$ of the first anode is on the order of six-tenths of a centimeter.

The energy imparted to the electrons by the cathode assembly 44 results in only a small electron velocity and any local space charge at the cathode is dissipated by the high positive electrostatic field created by the high voltage anode signal on the first anode 70 which extends through the free drift region $L_1$ into the region of the negative electrostatic field provided by the control grids 62, 66. The positive electric field causes the acceleration of the electrons immediately after emission from the cathode, restricting the angle of divergence of the emitted hollow electron beam. As stated hereinbefore, the maximum divergence of any electron in the beam on exit from the control grid 66 is limited by the diameter $d_1$ of the control grid output aperture which prohibits electrons having a greater divergence angle from traveling down the E-O column. As the electron beam continues to converge in the free drift area $L_2$ under the influence of the positive electrostatic field, it is further restricted by the narrowed input aperture 72 of the anode 70 which has a diameter $d_1$ approximately one-third smaller than the output aperture 67 of the control grid 66. However, for proper diameter modulation the hollow electron beam requires a low divergence angle on the order of $\alpha < 2.5 \times 10^{-3}$ radians such that a second anode is provided as part of an electrostatic coaxial lens assembly 74, to further restrict the electron beam divergence. The use of two control grids and two anode assemblies within a single E-O column represent a general combination of the telefocus gun assembly of K. H. Steigerwald, as reported in *Optik Magazine,* Vol. 5, pages 469–478, and the gun designed by Enis Bas for use in panoramic x-ray tubes, *Zeitschr Fur Angew. Physik,* Vol. 11, pages 370–375, 1959. However, the similarities between these two guns and the present assembly extend only to the general concepts. Neither of these two gun assemblies, either alone or in combination, provide the electron beam characteristic required for beam diameter modulation.

The electrostatic coaxial lens assembly 74 is similarly disposed in a coaxial manner with the preceding elements along a further portion of the Z axis, at a distance $L_4$ from the output aperture of the first anode 70. The coaxial lens assembly includes the second anode assembly 76 which is also a hollow, cylindrical structure of determined longitudinal length $L_5$. The second anode has coaxial input and output apertures having a diameter equal to that of the output aperture of the first anode 70. The surface of the second anode 76 is also connected to the conductor 71, such that both the first and second anodes are at the same anode potential value. The lens assembly 74 further includes a beam modulator assembly disposed within the spatial volume enclosed by the second anode 76, the beam modulator including an axial electrode 78, supporting web assemblies 80, 81, and first and second anode modulator rings 84, 86. The axial electrode 78 is in the shape of a long slendor rod, positioned along the central axis of the anode 76. The electrode may be a solid rod or a hollow closed end tube, and it has an outside diameter in the range of 0.02 to 0.03 centimeters and a length equal to, and in register with, the length $L_5$ of the second anode assembly 76. The inside cylinder diameter of the anode 76 is approximately 1.90 centimeters which is equal to that of the first anode 70, and the length $L_5$ is approximately 2.63 centimeters.

The axial electrode 78 is suspended on each end by the structural web assemblies 80, 81, each identical, and each of which may comprise three vanes radially spaced at 120° along the circumference of the axial electrode. The vanes may be welded or brazed to the electrode and to the inside cylindrical wall of the second anode to provide mechanical support of the electrode in addition to providing electrical continuity between the electrode and anode body. Since the web assemblies extend into the path of the electron beam some loss of beam current results from collision of the electrons with the structural vanes of the web. To minimize any secondary emission resulting from the collision, the web assemblies, and the end of the end of the electrode may be coated with a conductive material, such as aquadag. In addition, there is the possibility of fringe electric fields in the vicinity of the structural members which may provide electrostatic distortion of the beam. Therefore, the structural members of the web are as small as possible in keeping with the structural integrity of the assembly, and in addition to the vanes shown may include tensioned tungsten wires similarly connected through welding or brazing to the center electrode and the body of the second anode 76. As stated, the webs 80, 81 provide electrical continuity from the surface of the second anode to the axial electrode such that the electrode is at the same high voltage potential as the second anode.

The concept of using an axial electrode in an electrostatic or in an electromagnetic lens within an electron gun assembly is not new, and has been described in the art as early as 1925 as reported by O. Klemperer, in the book entitled *Electron Optics,* Cambridge University Press, Second Edition, 1953, pages 152, 153. There the use of an axial electrode in an electrostatic coaxial lens is provided in combination with annular electrodes. A voltage potential is applied to the axial electrode to provide increased acceleration of the paraxial electrons towards the axis of the electrodes, thereby decreasing the paraxial focal length. The function of the axial electrode described by Klemperer was to provide aberration correction, i.e. total convergence of the electron beam to provide a uniform electron current density. In the modulated, hollow beam electron gun 34, the axial electrode 78 is used in combination with the anode modulators 84, 86 to modulate and change the hollow electron beam diameter.

The first and second anode modulator rings 84, 86 are also hollow cylindrical structures, coaxially suspended around the axial electrode 78 within the second anode 76 through suitable structural members. The diameters of each ring are equal and smaller than the inside diameter of the second anode to allow for electrical isolation between the rings and the inside surface of the anode. The input aperture of the first anode modulator ring 84 is located approximately 0.75 centimeter from the input aperture of the second anode, and the modulator ring has an approximate length of 0.3 centimeter. The second anode modulator ring 86 is separated from the first ring by a drift space $L_d$ along the Z axis of the anode 76. The length of the drift space determines the aspect ratio of the modulated electron beam, i.e. the ratio of the outside diameter to inside diameter of the beam, and may be varied in different gun assemblies to provide various ratios. For an aspect ratio of 2:1, the drift space length $L_d$ is on the order of 0.3 centimeter. As described in detail hereinafter, the first anode modulator 84 provides a modulated electrostatic field which causes a determined divergence of the hollow electron beam as it passes through the spatial region of the modulator ring assembly, and the second anode modulator provides a substantially complementary modulated electrostatic field which recollimates the beam within the spatial region of the second ring. The electric field intensity provided by each anode modulating ring varies inversely with the distance from the Z axis, therefore, the length of the second anode modulator ring is longer than that of the first ring so that both rings have approximately equal electron beam deflection sensitivities at the respective radial distances at which the electrons traverse the spatial region within the modulators. As such, the length of the second modulator is approximately 22 percent longer than that of the first. All of the dimensions described hereinbefore are nominal, and variations are permitted, depending upon the desired modulation range, aspect ratio, current density and anode voltage potential values.

Both anode modulators 84, 86 are electrically connected through vacuum compatible isolation resistors 88, 90 to the conductor 71 and subsequently to the anode supply $V_A$, and each are connected through conductors 92, 94 to the terminals 38, 40 (FIG. 1). The resistors 88, 90 and conductors 92, 94 are passed through openings in the wall structure of the second anode 76 and are electrically insulated from the wall, such as through the use of insulators 96, 98. The conductors 92, 94 pass through the wall of the neck portion 27 of the CRT 20 and are shown as being in the same vertical plane along the Z axis to facilitate fabrication, however, any suitable alternative interconnection may be provided. As will be described in detail hereinafter, the anode modulator rings 84, 86 are presented with modulation signals which are capacitively coupled through the terminals 38, 40 and conductors 92, 94. The resistors 88, 90 provide impedance isolation between the modulating signal sources and the high voltage anode supply.

The next element in the E-O column is a centering lens provided by two pairs of electromagnetic coils 100, 102, one each for the horizontal and vertical planes, and each pair suitably disposed at a determined distance along the Z axis from the output aperture of the second anode 76. The centering lens provides centering of the electron beam such that it is incident concentrically on the focus assembly (32, FIG. 1) and perpendicular to the plane of the focus assembly, in order to minimize anisotropic aberrations which distort the beam profile. The coils in each pair 100, 102 are connected through conductors, such as conductors 103, 104, to the connector assembly 28 to permit the application of the desired coil current and voltage potentials. The potentials of each coil may be equal, however, the ability to provide independent potential values on each allows for adjustment of the mechanical inaccuracies of the gun by adjusting the individual coil potential to ensure the concentric exit of the electron beam from the E-O column. Although shown as an electromagnetic assembly, the centering lens may also be an electrostatic assembly with a pair of plates in each of the two orthogonal planes. In the electrostatic assembly each plate must be floated at the anode potential voltage with the respective plate voltages superimposed thereon.

A hollow ring connector assembly 106 at the end of the E-O column, in combination with a plurality of glass rods 108, 110 and the connector assembly 28, provides a rigid, structural support for all of the elements in the E-O column. In addition, the ring connector has a plurality of tensioned fingers 112 which are brazed or welded to the collar of the ring connector, and which press against the inside wall surface of the neck portion 27 of the CRT 20 (FIG. 1), to provide electrical contact through the aquadag coating to the anode voltage supply. The conductor 71 is connected to a portion of the ring connector surface, such that electrical interconnection is provided from the anode voltage supply to the first and second anodes of the E-O column.

The fabrication of the elements of the modulated, hollow beam electron gun assembly 34 are compatible with present state of the art manufacturing techniques. The shapes of the various elements of the E-O column, i.e. cathode, control grids, and anode structures, are such that they lend themselves to sheet metal fabrication techniques which puts them into the domain of conventional tube manufacturing technology. All of the edges of the various electrode structures are beveled, in accordance with the techniques used in the state of the art fabrication of electron guns in general, to ensure the minimization of discontinuous electrostatic field gradients.

Figure 4:
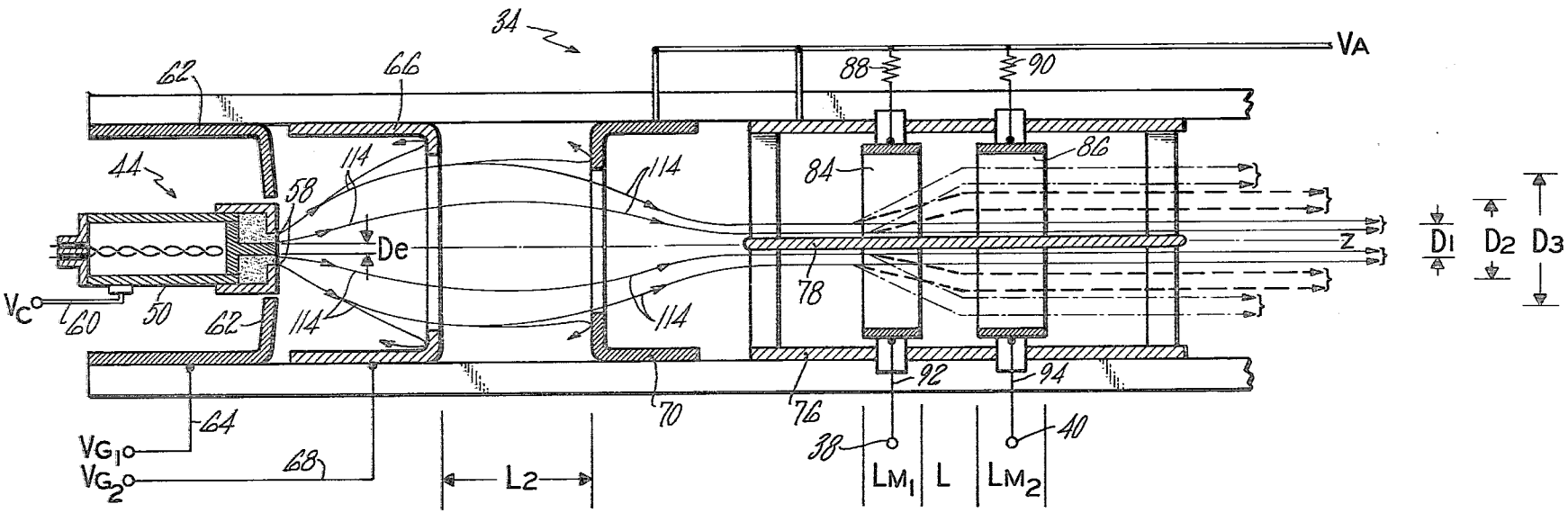
FIG. 4 is a sectional view of the electron gun assembly illustrated in perspective in FIG. 2.

Referring now to FIG. 4, in the operation of the electron gun 34 the electron beam emitted by the surface portion 58 of the cathode assembly 44, as illustrated by the plurality of lines 114, leave the cathode with a small acceleration force, however, the influence of the positive electrostatic field provided by the first anode assembly 70 influences the electrons while they are still within the controlled drift area defined by the spatial region within the second control grid 66. The voltage $V_{G1}$ is presented through the conductor 64 to the first control grid 62, while the voltage potential $V_{G2}$ is presented through the conductor 68 to the second control grid 66. The body 50 of the cathode assembly 44 is presented with a modulated cathode voltage potential $V_C$, having a variable magnitude representative of the intensity of a video signal applied to the CRT 20. The voltages are selected such that there is a relative positive to negative electric field gradient between the cathode 44 and the first and second control grids 62, 66. The relative magnitude of the electrostatic field between the cathode and control grids determines the degree of forward biasing of the cathode and the current density of the generated electron beam. A large positive to negative gradient reduces the electron emission to a value at cutoff wherein no electrons are emitted, and conversely a small gradient provides maximum, or full saturation emission. The hollow, cylindrical emitting surface 58 provides an emitted hollow beam which at the surface of the cathode has a dimension $D_e$. The electrostatic field provided by the second control grid 66, in combination with the effect of the positive electrostatic electric field provided by the first anode 70 causes the emitted electrons, which are diverging at the surface 58, to begin converging through acceleration of the electrons. Electrons leaving the second control grid 66 pass through the limited aperture $d_1$ (FIG. 2) which restricts the maximum permissible beam outer diameter (OD), and the electrons diverging beyond the diameter $d_1$ are trapped by the control grid structure and returned to the source. In the free drift area $L_2$ the electron beam further converges under the influence of the positive anode field and, upon entrance into the first anode area, is restricted to a maximum OD determined by the diameter $d_2$ of the first anode 70 input aperture (FIG. 2). Inside the first anode, the electron beam continues to converge for some increment along the Z axis until the influence of the positive electric field provided by the axial electrode 78 creates a counter potential to the electrostatic fields provided by the first anode 70, and second anode 76. At this point the electrons tend to become collimated at a beam diameter determined by the spatial equilibrium point of the electrostatic fields of the anodes 70, 76 and the axial electrode. In the absence of modulation signals presented to the anode modulator rings 84, 86, the radial electrostatic field created by the axial electrode 78 in combination with the electric field of the second anode 76 provide a fixed, constant OD and inside diameter (ID) to the emitted electron beam which determines the average diameter of the beam emitted from the E-O column. The electrons remain substantially collimated during propagation through the spatial region of the second anode 76 and are emitted from the electron gun assembly as a hollow electron beam having an average diameter $D_1$.

The diameter $D_1$ represents the minimum beam diameter value which is provided in the absence of beam modulation by the modulator rings 84, 86. To change the average beam diameter modulation signals are presented through the terminals 38, 40 and conductors 92, 94 to the modulator rings 84, 86. The modulation voltage signals are substantially complementary, such that if a $\Delta V^+$ modulation signal is applied to the modulator anode 84, a $\Delta V^-$ modulation signal of substantially the same magnitude but opposite polarity is applied to the anode modulator ring 86. The modulation signals are AC coupled to the modulator anodes to provide DC isolation between the high voltage anode supply $V_A$ and the modulation signal source and, therefore, add to the anode voltage potential $V_A$ presented to each modulator through the resistors 88, 90. In the electron gun assembly 34, the anode modulator 84 receives positive polarity voltage modulation signals and the modulator 86 receives negative polarity signals, such that the expression for the electric potential on the ring 84 ($V_{M1}$) is equal to: $V_{M1} = V_A + \Delta V^+$; and that for the ring 86 ($V_{M2}$) is: $V_{M2} = V_A + \Delta V^-$. For the purposes of a qualitative analysis of the functioning of the anode modulator ring, it may be assumed that the absolute magnitude of the respective modulation signals are equal. In fact, however, the absolute magnitude of each will be slightly different since the electric field intensity varies inversely with the radial distance of the beam electrons from the center electrode, such that the modulator ring 86 requires a slightly longer longitudinal length ($L_{M2}$) than that of the ring 84 ($L_{M1}$), as stated hereinbefore, and in addition a slightly larger absolute potential magnitude. The two modulating signals are however complementary in a sense that the polarities of each are opposite and essentially track each other in absolute magnitude.

In the operation of the beam modulator assembly, step voltage modulation signals $+\Delta V$, $-\Delta V$ are presented to the modulator rings 84, 86 respectively, altering the electrostatic field provided by each. The cylindrical wall of the anode modulator 84 becomes more positive than the center electrode 78 by a value $\Delta V^+$ causing the electrons to be attracted toward the wall of the anode and to radially diverge from the axial electrode 78. The beam divergence continues while the electron is under the influence of the electrostatic field of the ring 84 which extends beyond the ring structure into the adjacent spatial area and into the drift space between the two rings 84, 86. At some point in the drift space $L_d$ the electrons come under the influence of the electric field provided by the anode modulator ring 86, which provides a negative electric field gradient extending from the wall of the anode to the axial electrode, i.e. the wall of the anode ring 86 is more negative than the potential on the axial electrode by the magnitude of the modulation signal $\Delta V^-$. The negative field gradient cancels the diverging influence presented by the electrostatic field of the first ring 84. As a result, the electron beam is recollimated within the region of the second ring 86 and is emitted at a new average diameter $D_2$ with approximately the same aspect ratio. The magnitude of the modulating signals determine the change in beam average diameter, such that for a greater absolute magnitude modulation signal, the beam diverges to a greater extent within the spatial region of the anode modulator 84 to provide a beam of average diameter $D_3$. The aspect ratio of the beam is substantially constant over a range of diameter change of approximately 2:1.

The electron beam is highly sensitive to the change in the electrostatic field equilibrium created by the modulator rings in response to the modulation signals. This results in comparatively small absolute magnitude modulation signals, less than 10 volts for an anode voltage potential of 25 kilovolts, for a range of beam diameter modulation on the order 2:1. The modulation signal magnitudes would similarly be directly proportional to the magnitude of the anode supply voltage, such that an anode supply of 20 kilovolts requires smaller magnitude modulation signals. Conceivably the modulation of the beam diameter may be piecewise continuous, i.e. the use of AC voltage modulation, however, in a preferred use of the gun assembly modulation of the beam diameter occurs in discrete steps. Therefore, discrete DC level step signals may be used to provide the change in diameter and maintain the changed diameter value for a determined interval, the change in beam diameter average value being substantially linear with respect to the magnitude of the modulation signals. Such DC modulation signals and a typical embodiment of a modulator source circuit is shown and described in the hereinbefore referenced copending application.

The modulated, hollow beam electron gun 34 provides a number of advantages over the solid beam electron guns of the prior art for use in CRT's for display of video information. Among these are the fact that the hollow beam is less susceptible to beam spreading due to coulomb repulsion since the beam has less current density at the center. In a typical embodiment, the modulated hollow beam electron gun assembly 34 provides a beam current on the order of 250 microamps for a CRT anode voltage potential of 25 kilovolts. The inner and outer electron beam diameters are on the order of 0.38 and 0.51 millimeters respectively for the largest diameter beam at the screen. The modulation range of the beam diameter is approximately 2:1, and the modulation bandwidth may extend as high as fifty megahertz. The electron gun 34 provides the hollow electron beam with the parameters described with some deflection aberrations which manifest themselves as additional spot growth, and loss of current density at the extremities of the deflection arc and which are on the same order as that produced by a solid electron beam. Although mechanical imperfections in the fabrication of the electrostatic coaxial lens 74 do provide some distortion in the electric fields provided in the E-O column, the beam is comparatively insensitive to the mechanical tolerances. Analysis has shown that a mechanical displacement of the axial electrode 78 by a value equal to the radius of the electrode produces a one to two percent variation in the hollow beam diameters from those provided by the mechanically perfect case. Furthermore, analysis has shown that mechanical tolerances in the E-O column, and specifically in the electrostatic coaxial lens assembly 74, up to $\pm 10$ percent will have no significant affect upon the performance of the gain modulation. A possible additional component to the CRT 20, which is not shown in FIG. 1, is an astigmator of a type well known in the art which is an electromagnetic coil assembly which corrects for any ellipticity in the generated electron beam due to mechanical defects in the gun, astigmatism in the focusing lens yoke assembly (32, FIG. 1), or the effects of deflection astigmatism at the edges of the scan field arc.

Similarly, although the invention has been shown and described with respect to an illustrative embodiment thereof, it should be understood by those skilled in the art that the foregoing and various other changes, omissions and additions in the form and detail thereof may be made therein without departing from the spirit and scope of this invention.

Having thus described a typical embodiment of our invention, that which we claim as new and desire to secure by Letters Patent is:

1. A modulatable, hollow beam electron gun apparatus having an electron-optical (E-O) column for providing a hollow electron beam of instantaneous average diameter determined by instantaneous inner diameter and outer diameter values, for use in a CRT which provides a visual image in response to video signals, bias voltage signals, anode voltage signals, and a pair of concurrent beam modulation signals presented thereto from a system having a source of video signals, a source of bias signals, a source of anode voltage signals, and a source of concurrent modulation signals, comprising:

cathode assembly means, disposed at one end of a longitudinal axis of the E-O column and connected for response to the video source, said cathode means having an electron emitting surface adapted for providing a hollow electron beam of determined inner and outer diameter at a current density in dependence on the video signal magnitude;

control grid means, disposed along a successive portion of said longitudinal axis coaxially with, and adjacent to, the electron emitting surface of said cathode means and connected for response to the bias voltage source, said control grid means providing modulation of the electron beam current density in response to the magnitude of the bias voltage signals, in cooperative relationship with said cathode means;

first anode means, coaxially disposed along another successive portion of said longitudinal axis adjacent to said control grid means and connected for response to the anode voltage source, said first anode means providing a first electrostatic field in response to the magnitude of the anode voltage signal, said first electrostatic field being relatively positive with respect to said cathode means and said control grid to provide acceleration of the hollow electron beam emitted by said cathode means; and electrostatic coaxial lens means, coaxially disposed along another successive portion of said longitudinal axis adjacent to said first anode means and connected for response to the anode voltage source and to the source of concurrent modulation signals, said coaxial lens means providing further acceleration of the electron beam in response to the magnitude of the anode voltage signal, and said coaxial lens means providing a change in the instantaneous average diameter of the emitted electron beam in dependence on the magnitudes of the concurrent modulation signals.

2. The electron gun apparatus of claim 1, wherein said cathode assembly means is a fixed diameter ring, dispenser type cathode having a hollow, cylindrical electron emitting surface of determined inner and outer diameter for providing said hollow electron beam of substantially equal determined inner and outer diameter, said cathode assembly including an outer casing structure of determined diameter.

3. The electron gun apparatus of claim 2, wherein said control grid means comprises first and second grid means.

4. The electron gun apparatus of claim 3 wherein each of said first and second grid means comprise a hollow cylindrical structure having coaxial input and output apertures, said first grid means having an input aperture of determined diameter greater than that of said cathode means casing structure and having an output aperture of determined diameter greater than the outer diameter of said cylindrical electron emitting surface, said first grid means enclosing said cathode means without interference with the emitted hollow beam, said second grid means coaxially disposed with said first grid means and having an input aperture of determined diameter equal to that of said first grid means input aperture and having an output aperture of determined diameter for providing a restriction on the maximum divergence of the emitted electron beam, each of said grid means being connected for response to the source of the bias voltage signals for providing modulation of the electron beam current density in cooperative relationship with said cathode means.

5. The electron gun apparatus of claim 1, wherein said electrostatic coaxial lens assembly means comprises:

second anode means, having a hollow cylindrical structure of determined longitudinal length with coaxial input and output apertures, said second anode means connected for response to the anode voltage source for providing a second electrostatic field in response to the magnitude of the anode voltage signal, said second electrostatic field being relatively positive with respect to said cathode means and said control grid means, said second electrostatic field in combination with said first electrostatic field providing an increased beam acceleration, and low beam divergence angle at the emitting surface of said cathode means;

electrostatic beam modulator assembly means, nested within said second anode means in an axially symmetrical manner, and including axial electrode means having a determined longitudinal length equal to that of said second anode means and suspended on the central longitudinal axis of said second anode means through electrically conductive support means connected to the structure of said second anode means, said axial electrode means providing a positive axial electrostatic field in response to the anode voltage signal presented through said support means, said beam modulator means further including first and second anode ring modulator means relatively disposed at a determined drift distance along a different portion of the axial electrode means, each having a hollow cylindrical structure of determined longitudinal length with coaxial input and output apertures, the combined longitudinal lengths of each anode ring and the drift distance being smaller than the longitudinal length of said second anode means, each of said ring modulator means providing a spatial enclosure along the respectively disposed portion of the axial electrode means within the second anode means, each of said modulator ring means being electrically isolated from the structure of said second anode means through a corresponding one of a pair of isolation resistance means and each ring being responsive to a different one of a pair of concurrent modulation signals presented thereto through a corresponding one of a pair of electrical conductors.

6. The electron gun apparatus of claim 5 further including lens centering means, coaxially disposed along another successive portion of said longitudinal axis adjacent to said electrostatic coaxial lens means, said lens centering means including a pair of electrodes disposed in each of two orthogonal planes, each pair connected for response to a different output of the bias voltage source for providing centering of said emitted hollow electron beam along the central longitudinal axis of the E-O column in response to bias voltage signals presented thereto.

7. The electron gun apparatus of claim 5, wherein each of said ring modulator means provides an electrostatic field within the respective spatial enclosure provided thereby at a steady state magnitude in dependence on the magnitude of the anode voltage signal, each of said ring modulator means further providing a complementary modulated change in the magnitude of the respective electrostatic field in response to the absolute magnitude of a respective one of the concurrent pairs of modulation signals presented thereto, the modulated change in the electrostatic fields provided by said first and second ring modulator means, in combination, causing a corresponding divergence and recollimation of the electron beam propagating through the beam modulator means to provide said change in the instantaneous beam diameter.

* * * * *